US007928706B2

(12) United States Patent
Do Couto et al.

(10) Patent No.: US 7,928,706 B2
(45) Date of Patent: Apr. 19, 2011

(54) LOW DROPOUT VOLTAGE REGULATOR USING MULTI-GATE TRANSISTORS

(75) Inventors: Andre Luis Do Couto, Jaguariuna (BR); Fabio Hideki Okuyama, Campinas (BR)

(73) Assignee: Freescale Semiconductor, Inc., Austin, TX (US)

( * ) Notice: Subject to any disclaimer, the term of this patent is extended or adjusted under 35 U.S.C. 154(b) by 479 days.

(21) Appl. No.: 12/142,948

(22) Filed: Jun. 20, 2008

(65) Prior Publication Data

US 2009/0315526 A1 Dec. 24, 2009

(51) Int. Cl.
*G05F 1/565* (2006.01)

(52) U.S. Cl. ..... 323/273

(58) Field of Classification Search ..... 323/273, 323/280, 281
See application file for complete search history.

(56) References Cited

U.S. PATENT DOCUMENTS

| | | | | |
|---|---|---|---|---|
| 4,516,082 | A | 5/1985 | Smith et al. | |
| 6,522,111 | B2 | 2/2003 | Zadeh et al. | |
| 2007/0132435 | A1 * | 6/2007 | Hasegawa et al. | 323/222 |
| 2009/0212753 | A1 * | 8/2009 | Lou | 323/277 |
| 2009/0315526 | A1 * | 12/2009 | Do Couto et al. | 323/275 |
| 2010/0026250 | A1 * | 2/2010 | Petty | 323/271 |
| 2010/0181985 | A1 * | 7/2010 | Inoue et al. | 323/311 |

OTHER PUBLICATIONS

Shibata, A Functional MOS Transistor Featuring Gate-Level Weighted Sum and Threshold Operations, IEEE Transactions on Electron Devices, vol. 39, No. 6, Jun. 1992, pp. 1444-1455.

* cited by examiner

*Primary Examiner* — Jeffrey L Sterrett

(57) ABSTRACT

A voltage regulator includes a first multi-gate transistor, a differential stage, a second stage having a second multi-gate transistor, and a pass transistor to apply an output voltage and output current to a device load. Based on a feedback voltage associated with the output voltage, the differential stage modulates a bias voltage applied to a control electrode of the pass transistor. A first gate of the second multi-gate transistor generates a nominal bias current for the pass transistor, and the second gate adjusts the bias voltage based on an output of the differential stage so that transients in the regulator output voltage resulting from sudden changes in current drawn by the device load are reduced.

20 Claims, 2 Drawing Sheets

100

100

LOW DROPOUT VOLTAGE REGULATOR USING MULTI-GATE TRANSISTORS

FIELD OF THE DISCLOSURE

The present disclosure relates to voltage regulator devices, and more particularly to low drop-out (LDO) voltage regulators.

BACKGROUND

A voltage regulator accepts a variable or unknown input voltage and provides a substantially constant output voltage at a regulated level. The stability of the regulated output voltage allows the voltage to be used as a supply voltage for a device load. In some devices, the amount of current drawn by the device load can vary, and it is typically desirable that the output voltage of the voltage regulator be substantially independent of the output current (i.e. the load current). For example, a voltage regulator can supply power to a device load having digital logic, and switching at the logic gates can vary the amount of current drawn by the load. It is typically desirable that the output voltage remain relatively insensitive to changes in the load current due to the switching activity.

One example of a linear voltage regulator is a low-dropout (LDO) regulator, which is characterized by its ability to regulate the output voltage at a low voltage differential between an input and an output of the regulator. A pass element (e.g., a power transistor) is connected in series between the input terminal and the output terminal of the LDO regulator, and provides the load current to the output terminal of the LDO regulator. However, sudden changes in the load current can cause transient changes in the output voltage, resulting in undesirable degradation of performance at the device load.

DETAILED DESCRIPTION

A voltage regulator includes a first multi-gate transistor, a differential stage, a second stage having a second multi-gate transistor, and a pass transistor to apply an output voltage and output current to a device load. Based on a feedback voltage associated with the output voltage, the differential stage modulates a bias voltage applied to a control electrode of the pass transistor. A first gate of the second multi-gate transistor generates a nominal bias current for the pass transistor, and the second gate adjusts the bias voltage based on an output of the differential stage so that transients in the regulator output voltage resulting from sudden changes in current drawn by the device load are reduced.

Figure 1:
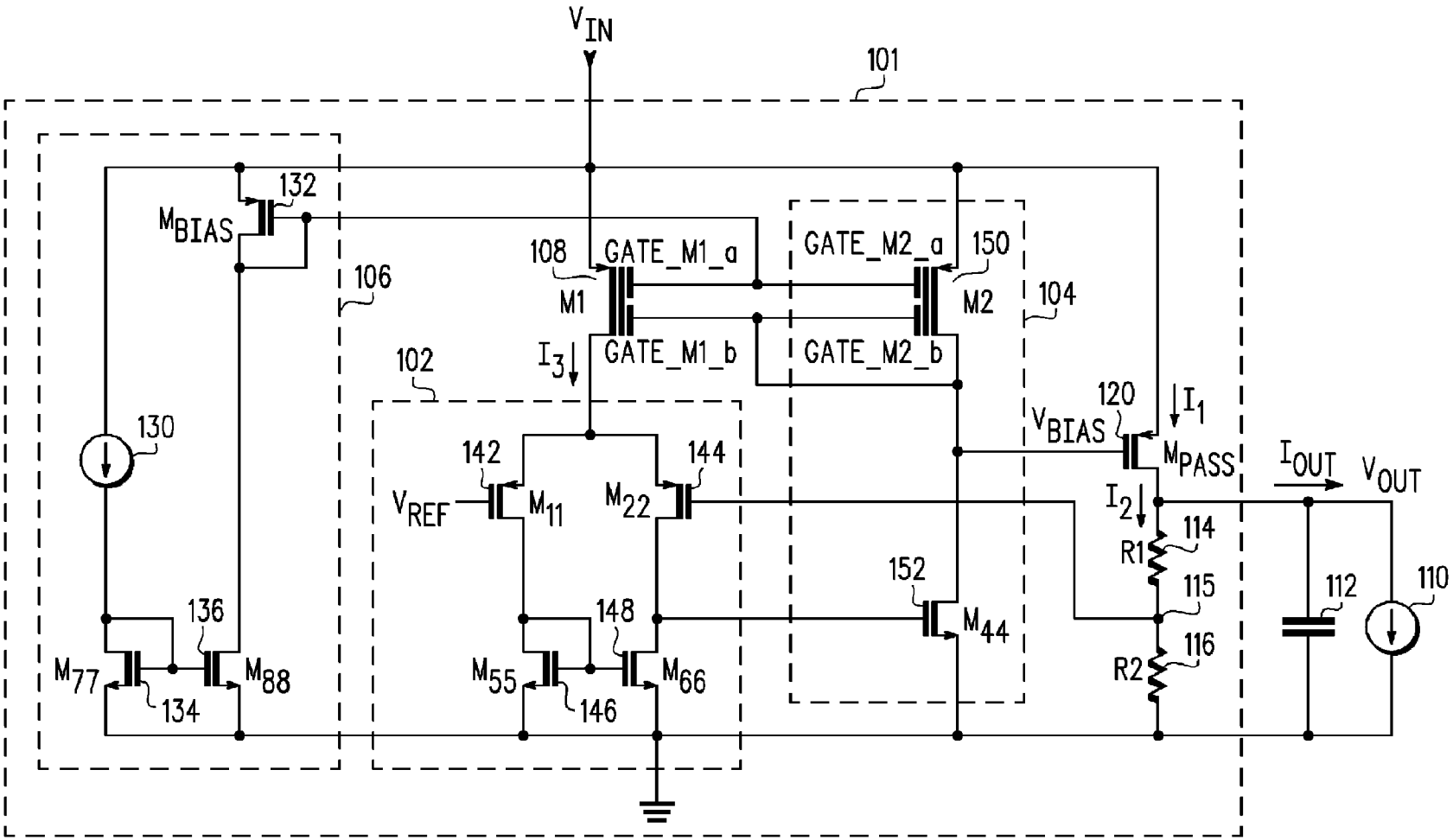
FIG. 1 is a circuit diagram of an electronic device in accordance with one embodiment of the present invention.

Referring to FIG. 1, a circuit diagram of an electronic device 100 is illustrated. The electronic device 100 includes a voltage regulator 101, a capacitor 112, and a device load 110 illustrated as a current source. The voltage regulator 101 includes a first terminal connected to a first power supply voltage terminal to receive application of a voltage, labeled "$V_{IN}$", a second terminal connected to a second power supply voltage terminal to receive application of a ground voltage reference, and an output configured to provide an output voltage labeled "$V_{OUT}$" and an output current $I_{OUT}$. The capacitor 112 includes a first terminal connected to the output of the voltage regulator 101 and a second terminal connected to the second power supply voltage terminal. The device load 110 includes a first terminal connected to the output of the voltage regulator 101 and a second terminal connected to the second power supply voltage terminal.

The electronic device 100 can be any kind of electronic device that requires application of a voltage to perform specified tasks. For example, the electronic device 100 can be a computer device, such as a desktop or laptop computer, a portable electronic device, such as a mobile phone or personal music player, and the like. The device load 110 represents one or more functional modules of the electronic device 100. In particular, in response to application of the voltage $V_{OUT}$ at a specified magnitude, the device load 110 enters a normal mode of operation to execute the specified tasks of the electronic device 100. In the normal mode of operation, a electrical characteristics associated with the device load 110 can change, causing the device load 110 to draw more current and increasing a magnitude of the current $I_{OUT}$. For example, the device load 110 can be switched on or off, or enter or exit a low-power mode, resulting in a sudden change to the magnitude of the current $I_{OUT}$.

The capacitor 112 is configured as a low-pass filter such that the device load 110 is insulated from high frequency transients in the voltage $V_{OUT}$. This improves the stability of the voltage applied to the device load 110, improving performance of the electronic device 100.

The voltage regulator 101 is configured to receive application of the voltage $V_{IN}$ and provide the voltage $V_{OUT}$ as a regulated output voltage. The voltage $V_{IN}$ can be based on a battery voltage or other power source voltage and can vary (for example, as the battery voltage degrades over time, the voltage $V_{IN}$ will be reduced). Accordingly, the voltage regulator 101 is configured to provide the voltage $V_{OUT}$ at a stable magnitude that is substantially independent of variations in the voltage $V_{IN}$. In addition, the voltage regulator 101 is configured to maintain the voltage $V_{OUT}$ at a stable magnitude independent of variations in the current $I_{OUT}$ drawn by the load 110. In the illustrated example of FIG. 1, the voltage regulator 101 is a low drop-out (LDO), characterized by a relatively small difference between $V_{IN}$ and $V_{OUT}$.

The voltage regulator 101 includes a differential stage 102, a second stage 104, a bias circuit 106, a p-channel multi-gate transistor 108, and a p-channel pass transistor 120. The bias circuit 106 includes a first terminal connected to the first power supply voltage terminal, a second terminal connected to the second power supply voltage terminal, and an output. The multi-gate transistor 108 includes a first current electrode connected to the first power supply voltage terminal, a second current electrode, a first gate electrode connected to the output of the bias circuit 106, and a second gate electrode.

The differential stage 102 includes a first input configured to receive a reference voltage, labeled "$V_{REF}$", a second input, a first terminal connected to the second current electrode of the multi-gate transistor 108, and a second terminal connected to the second power supply voltage terminal. The second stage 104 includes a first terminal connected to the first power supply voltage terminal, a second terminal and a third terminal connected to the first gate and the second gate, respectively, of the multi-gate transistor 108, a fourth terminal connected to the second power supply voltage terminal, a first input connected to the first terminal of the device load 110, and an output connected to the second input of the differential stage 102. The pass transistor 120 includes a first current electrode connected to the first power supply voltage terminal, a second current electrode connected to the first terminal of the device load 110, and a control electrode connected to the second terminal of the second stage 104.

In the illustrated embodiment of FIG. 1, the bias circuit 106 includes a current source 130, a p-channel transistor 132, and n-channel transistors 134 and 136. The current source 130 includes a first terminal connected to the first power supply voltage terminal, and a second terminal. The transistor 132 includes a first current electrode connected to the first power supply voltage terminal, a second current electrode, and a control electrode connected to the second current electrode and also connected to the first current electrode of the multi-gate transistor 108. The transistor 134 includes a first current electrode connected to the second terminal of the current source 130, a second current electrode connected to the second power supply voltage terminal, and a control electrode connected to the first current electrode. The transistor 136 includes a first current electrode connected to the second current electrode of the transistor 132, a second current electrode connected to the second power supply voltage terminal, and a control electrode connected to the control electrode of the transistor 134.

The differential stage includes p-channel transistors 142 and 144 and n-channel transistors 146 and 148. The transistor 142 includes a first current electrode connected to the second current electrode of the multi-gate transistor 108, a second current electrode, and a control electrode configured to receive application of the voltage $V_{REF}$. The transistor 144 includes a first current electrode connected to the second current electrode of the multi-gate transistor 108, a second current electrode, and a control electrode connected to the output of the second stage 104. The transistor 146 includes a first current electrode connected to the second current electrode of the transistor 142, a second current electrode connected to the second power supply voltage terminal, and a control electrode connected to the first current electrode. The transistor 148 includes a first current electrode connected to the second current electrode of the transistor 144, a second current electrode connected to the second power supply voltage terminal, and a control electrode connected to the control electrode of the transistor 146. The first current electrode of the transistor 148 is also connected to the output of the differential stage 102.

The second stage 104 is configured as an inverting gain stage, and includes a p-channel multi-gate transistor 150 and an n-channel transistor 152. In other embodiments, the second stage 104 can be configured as a follower stage. The multi-gate transistor 150 includes a first current electrode connected to the first power supply voltage terminal, a second current electrode connected to the control electrode of the pass transistor 120, a first control electrode connected to the first control electrode of the multi-gate transistor 108, and a second control electrode connected to the second current electrode and also connected to the second control electrode of the multi-gate transistor 108. The transistor 152 includes a first current electrode connected to the second current electrode of the multi-gate transistor 150, a second current electrode connected to the second power supply voltage terminal, and a control electrode connected to the output of the differential stage 102.

The voltage regulator 101 also includes resistors 114 and 116. The resistor 114 includes a first terminal connected to the second current electrode of the pass transistor 120 and a second terminal connected to a node 115. The resistor 116 includes a first terminal connected to the node 115 and a second terminal connected to the second power supply voltage terminal.

In steady state operation of the voltage regulator 101, the differential stage 102 ensures that the output voltage $V_{OUT}$ matches a specified voltage within a specified tolerance. In particular, the differential stage 102 compares the voltage $V_{REF}$ with the voltage at node 115. The voltage at node 115 is based on the voltage $V_{OUT}$, and is determined by a ratio of the resistive values for resistor 114 and resistor 116. Accordingly, the resistor 114 and 116 are selected so that the ratio of resistive values cause the voltage at node 115 to equal $V_{REF}$ when the level of $V_{OUT}$ is at a desired value.

As the voltage $V_{OUT}$ varies from the specified level, the voltage at node 115 will deviate from the voltage $V_{REF}$. In response to the deviation, the differential stage will change the voltage applied at the control electrode of the transistor 152. This in turn will modulate the voltage applied at the control electrode of the pass transistor 120, causing a change in the transistor's conductivity. The change in conductivity changes the current, labeled "$I_1$" through the pass transistor 120, in turn changing the current $I_{OUT}$ and the output voltage $V_{OUT}$. The differential stage 102 continues to modulate the conductivity of the transistor 152 until the feedback voltage at node 115 matches the voltage $V_{REF}$. This ensures the voltage $V_{OUT}$ is set to a stable level, even when the voltage $V_{IN}$ varies or is unknown.

During the steady state operation of the voltage regulator 101, the transistors 132, and 134, and 136 provide a minimum quiescent current for operation of the regulator. In particular, the transistors 134 and 136 mirror the current provided by the current source 130. As used herein a first current mirrors a second current when the magnitude of the first current is proportional to the second. Accordingly, the quiescent current through the transistor 136 is proportional to the current provided by the current source 130. The transistor 132 supplies a voltage at its control electrode that is applied to the gate electrode at the multi-gate transistor 108 so that the multi-gate transistor mirrors the quiescent current as a nominal current through the transistor. In addition, drain of the transistor 132 is connected to the first gate electrode of the multi-gate transistor 150, the nominal current will also be mirrored at multi-gate transistor 150. Thus, the nominal current through the multi-gate transistor 150 is established by the voltage at the drain of the transistor 132.

In addition, when the load current $I_{OUT}$ changes, the multi-gate transistors 108 and 150 are configured to adaptively change the voltage, labeled "$V_{BIAS}$", applied to the control electrode of the transistor 120. For example, when the current $I_{OUT}$ increases (due to a higher load at device load 110), this causes a drop in the current (labeled "$I_2$") through the resistor 114 and also causing a drop in the voltage at node 115. This drop in voltage increases the conductivity of the transistor 144, thereby increasing the current (labeled "$I_3$") at the first terminal of the differential stage 102. Due to the increase in conductivity of the transistor 144, more of the current $I_3$ is diverted through the transistor 144 relative to the transistor 142. The diversion of current causes the drain voltage at transistor 152 to drop, resulting in a commensurate drop in voltage at the second control electrode of the multi-gate transistor 150. Multi-gate transistor 150 thereby becomes more conductive, increasing the current through the transistor and also increasing the voltage $V_{BIAS}$. The increase in current through the multigate transistor temporarily increases the gain of the feedback loop formed by the second stage 104 and the differential stage 102, thereby increasing the responsiveness of the loop due to the change in the load current $I_{OUT}$. Thus, the adaptive bias configuration of the multi-gate transistors 108 and allows the voltage regulator 101 to adapt more quickly to sudden changes in load current.

It will be appreciated that, by using multiple gate transistors in the voltage regulator 101, a separate sense transistor is not required to sense the level of output load at the device load 110 in order to adjust the bias current $I_{BIAS}$. Accordingly, the illustrated voltage regulator 101 saves area and avoids potential matching issues between a sense transistor and the pass transistor 120. In addition, the illustrated regulator does not employ additional stages to apply additional bias current to the differential stage 102, thereby reducing the current consumption of the regulator.

It will also be appreciated that the multi-gate transistors 108 and 150 can be any type of transistor having more than one control electrode, whereby a (drain to source) current through the transistor is based upon voltages applied at each control electrode. Accordingly, the multi-gate transistors 108 and 150 can each be a multiple independent gate field effect transistor (MIGFET), a FinFET transistor, a floating gate metal oxide semiconductor (FGMOS) transistor, a tri-gate transistor, and the like.

Figure 2:
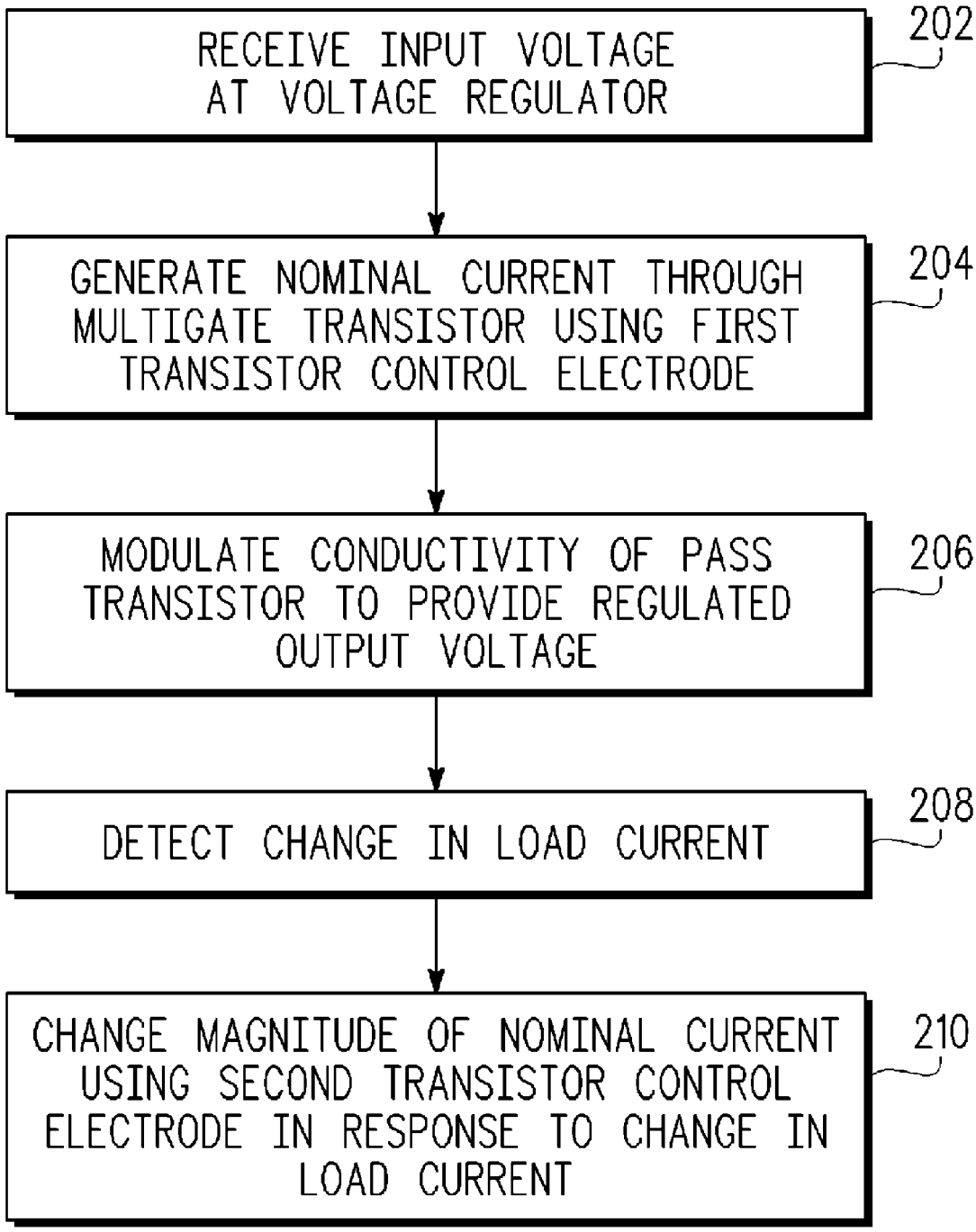
FIG. 2 is a flow diagram illustrating a particular embodiment of regulating voltage at the electronic device of FIG. 1.

Referring to FIG. 2, a flow diagram of a method of regulating voltage at the voltage regulator 101 is illustrated. At block 202, an input voltage ($V_{IN}$) is received at the first input terminal of the voltage regulator 101. At block 204, a nominal current through the multi-gate transistor 150 based on a voltage at the first control electrode of the transistor. At block 206, the conductivity of the pass transistor 120 is modulated based on the nominal current through the multi-gate transistor 150. The conductivity is modulated in order to provide the regulated voltage $V_{OUT}$ based on the voltage $V_{IN}$. At block 208, a change in the load current $I_{LOAD}$ is detected at the differential stage 102 based on a change in voltage at the node 115. At block 210, in response to detecting the change in the current $I_{LOAD}$, the voltage at the second control electrode of the multi-gate transistor 150 is adjusted. This adjusts the magnitude of the current through the multi-gate transistor 150, thereby adjusting the bias current of the pass transistor 120. The adjustment in bias current reduces the impact of the change in the current $I_{OUT}$ on the output voltage $V_{OUT}$, thus improving performance of the voltage regulator 101.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A low dropout (LDO) voltage regulator comprising:

a first multi-gate transistor having a first current electrode coupled to a first power supply voltage terminal, a first gate for receiving a reference signal, a second gate, and a second current electrode for providing a first current;

a differential stage having a first terminal coupled to said second current electrode of said first multi-gate transistor, and a second terminal coupled to a second power supply voltage terminal, for selectively diverting said first current in response to a difference between a reference voltage and a feedback voltage to provide a voltage on an output terminal thereof;

a second stage having an input terminal coupled to said output terminal of said differential stage, and an output terminal coupled to said second gate of said first multi-gate transistor; and a pass transistor having a first current electrode for receiving an input voltage, and a second current electrode for providing an output voltage, and a control electrode coupled to said output terminal of said second stage.

2. The LDO voltage regulator of claim 1, wherein said second stage comprises:

a second multi-gate transistor, having a first current electrode coupled to said first power supply voltage terminal, a first gate for receiving said reference signal, a second gate, and a second current electrode coupled to said second gate and to said output terminal of said second stage; and a first transistor having a first current electrode coupled to said second current electrode of said second multi-gate transistor, a control electrode coupled to said output terminal of said differential stage, and a second current electrode coupled to said second power supply voltage terminal.

3. The LDO voltage regulator of claim 1, wherein the first multi-gate transistor is a multiple independent gate field effect transistor (MIGFET).

4. The LDO voltage regulator of claim 3, wherein the first multi-gate transistor is selected from the group consisting of a FinFET transistor, a floating gate metal oxide semiconductor (FGMOS) transistor, and a tri-gate transistor.

5. The LDO voltage regulator of claim 1, further comprising a bias circuit comprising an output configured to generate the reference signal.

6. The LDO voltage regulator of claim 5, wherein the bias circuit comprises:

a current source comprising a first terminal coupled to the first power supply voltage terminal and a second terminal;

a first transistor comprising a first current electrode coupled to the second terminal of the current source, a second current electrode coupled to the second power supply voltage terminal, and a control electrode coupled to the first current electrode;

a second transistor comprising a first current electrode, a second current electrode coupled to the second power supply voltage terminal, and a control electrode coupled to the control electrode of the first transistor; and a third transistor comprising a first current electrode coupled to the first power supply voltage terminal, a second current electrode coupled to the first current electrode of the second transistor, and a control electrode coupled to the second current electrode, the second current electrode configured to generate the reference signal.

7. The LDO voltage regulator of claim 1, further comprising:

a first resistor comprising a first terminal coupled to the second current electrode of the pass transistor and a second terminal configured to generate the feedback voltage; and a second resistor comprising a first terminal coupled to the second terminal of the first resistor and a second terminal coupled to the second power supply voltage terminal.

8. The LDO voltage regulator of claim 1, wherein the differential stage comprises:

a first transistor comprising a first current electrode coupled to the second current electrode of the first multi-gate transistor, a second current electrode, and a control electrode to receive the reference voltage;

a second transistor comprising a first current electrode coupled to the second current electrode of the first multi-gate transistor, a second current electrode, and a control electrode to receive the feedback voltage;

a third transistor comprising a first current electrode coupled to the second current electrode of the first transistor, a second current electrode coupled to the second power supply voltage terminal, and a control electrode coupled to the first current electrode; and a fourth transistor comprising a first current electrode coupled to the second current electrode of the second transistor, a second current electrode coupled to the second power supply voltage terminal, and a control electrode coupled to the control electrode of the third transistor.

9. A low dropout (LDO) voltage regulator, comprising:

a pass transistor comprising a first current electrode coupled to a first power supply voltage terminal, a second current electrode configured to be coupled to a load, and a control electrode; and a first multi-gate transistor, the first multi-gate transistor comprising a first current electrode coupled to the first power supply voltage terminal, a second current electrode configured to provide a bias voltage to the control electrode of the pass transistor, a first gate configured to receive a reference signal and a second gate coupled to the second current electrode.

10. The LDO voltage regulator of claim 9, further comprising a second multi-gate transistor comprising a first current electrode coupled to the first power supply voltage terminal, a second current electrode, a first gate coupled to the first gate of the first multi-gate transistor, and a second gate coupled to the second gate of the first multi-gate transistor.

11. The LDO voltage regulator of claim 10, further comprising a differential stage comprising a first terminal coupled to the second current electrode of the second multi-gate transistor, a second terminal configured to receive a reference voltage, and a third terminal coupled to receive a feedback voltage, the differential stage configured to divert a first current based on a difference between the feedback voltage and the reference voltage, the first current provided at the second current electrode of the second multi-gate transistor.

12. The LDO voltage regulator of claim 11, wherein the differential stage further comprises:

a first transistor comprising a first current electrode coupled to the second current electrode of the second multi-gate transistor, a second current electrode, and a control electrode to receive the reference voltage;

a second transistor comprising a first current electrode coupled to the second current electrode of the second multi-gate transistor, a second current electrode, and a control electrode to receive the feedback voltage;

a third transistor comprising a first current electrode coupled to the second current electrode of the first transistor, a second current electrode coupled to a second power supply voltage terminal, and a control electrode coupled to the first current electrode; and a fourth transistor comprising a first current electrode coupled to the second current electrode of the second transistor, a second current electrode coupled to the second power supply voltage terminal, and a control electrode coupled to the control electrode of the third transistor.

13. The LDO voltage regulator of claim 12, further comprising:

a fifth transistor comprising a first current electrode coupled to the second current electrode of the first multi-gate transistor, a second current electrode coupled to the second power supply voltage terminal, and a control electrode coupled to the second current electrode of the second transistor.

14. The LDO voltage regulator of claim 11, further comprising:

a first resistor comprising a first terminal coupled to the second current electrode of the pass transistor and a second terminal coupled to the third terminal of the differential stage; and a second resistor comprising a first terminal coupled to the second terminal of the first resistor and a second terminal coupled to a second power supply voltage terminal.

15. The LDO voltage regulator of claim 10, further comprising a bias circuit comprising an output terminal configured to provide the reference signal.

16. The LDO voltage regulator of claim 15, wherein the bias circuit comprises:

a current source comprising a first terminal coupled to the first power supply voltage terminal and a second terminal;

a first transistor comprising a first current electrode coupled to the second terminal of the current source, a second current electrode coupled to the second power supply voltage terminal, and a control electrode coupled to the first current electrode;

a second transistor comprising a first current electrode, a second current electrode coupled to a second power supply voltage terminal, and a control electrode coupled to the control electrode of the first transistor; and a third transistor comprising a first current electrode coupled to the first power supply voltage terminal, a second current electrode coupled to the first current electrode of the second transistor, and a control electrode coupled to the second current electrode, the second current electrode configured to generate the reference signal.

17. A method of providing a regulated output voltage comprising:

receiving an input voltage at a first current electrode of a pass transistor;

modulating a conductivity of said pass transistor in response to a difference in voltage between a feedback voltage and a reference voltage to provide the regulated output voltage on a second current electrode of said pass transistor;

said modulating including generating a first current using a first gate of a first multi-gate transistor; and changing a magnitude of said first current using a second gate of said first multi-gate transistor in response to detecting a change in load current.

18. The method of claim 17, wherein changing a magnitude of the first current comprises increasing the first current in response to detecting an increase in load current.

19. The method of claim 17, wherein generating the first current comprises generating the first current using a first gate of a second multi-gate transistor.

20. The method of claim 19, wherein changing the magnitude of the first current comprises changing the magnitude using a second gate of the second multi-gate transistor.

* * * * *